US007896174B2

(12) United States Patent
Gilpatrick et al.

(10) Patent No.: US 7,896,174 B2
(45) **Date of Patent: *Mar. 1, 2011**

(54) HOSE HOOK FOR A PRESSURE WASHER

(75) Inventors: Richard J. Gilpatrick, Whitewater, WI (US); Daniel D. Monty, Eagle, WI (US); James L. Welch, Waukesha, WI (US)

(73) Assignee: Briggs and Stratton Corporation, Wauwatosa, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/489,856

(22) Filed: Jun. 23, 2009

(65) Prior Publication Data

US 2009/0255884 A1 Oct. 15, 2009

Related U.S. Application Data

(63) Continuation of application No. 11/003,156, filed on Dec. 3, 2004, now Pat. No. 7,562,780.

(51) Int. Cl.
*A47F 7/00* (2006.01)

(52) U.S. Cl. ..... 211/70.6

(58) Field of Classification Search ..... 239/149, 239/147, 146; D8/61, 67, 69, 373, 380, 381; D4/102; 15/97.01, 98, 22.1, 320; D34/24–26, D34/12, 14, 17; D6/553, 574, 552, 567; 211/70.6, 85.11, 126.1, 126.16, 13.1; 280/47.131, 280/63, 47.17, 47.19, 47.28; 248/75, 77–79, 248/89–93, 210, 211, 238, 239; 206/561, 206/562, 565, 557; D32/25, 19, 1, 15–17, D32/31–33

See application file for complete search history.

(56) References Cited

U.S. PATENT DOCUMENTS

| | | | |
|---|---|---|---|
| 1,981,674 | A | 11/1934 | Solomon |
| 2,434,140 | A | 1/1948 | Bernstein |
| D179,714 | S | 2/1957 | Wise |
| D206,426 | S | 12/1966 | Wise |
| 3,940,065 | A | 2/1976 | Ware et al. |
| 4,350,366 | A | 9/1982 | Helms |
| D300,406 | S | 3/1989 | Bordian |
| 4,874,147 | A | 10/1989 | Ory et al. |
| 4,880,248 | A | 11/1989 | Elmer |
| 4,899,970 | A | 2/1990 | Berzina |
| 5,299,767 | A | 4/1994 | Simpson |
| 5,419,497 | A | 5/1995 | Warrington |
| 5,452,830 | A | 9/1995 | Hopkins et al. |
| 5,687,856 | A | 11/1997 | Kendrena |

(Continued)

*Primary Examiner*—Jennifer E. Novosad
(74) *Attorney, Agent, or Firm*—Michael Best & Friedrich LLP

(57) ABSTRACT

An accessory tray for a pressure washer. The accessory tray of some embodiments has an accessory supporting portion for supporting and/or storing accessories of the pressure washer. The accessory supporting portion has a concave surface, which allows the accessories to be supported substantially normal to the ground regardless of the relative angle between the accessory tray and the ground. Some embodiments also have a flexible cantilevered member positioned above a portion of the accessory tray to trap an accessory against the accessory tray. Some embodiments can have a hose hook that supports and stores a hose of the pressure washer. The hose hook has a concave shape to allow the hose to be supported substantially normal to the ground.

18 Claims, 7 Drawing Sheets

U.S. PATENT DOCUMENTS

| | | | | |
|---|---|---|---|---|
| D396,924 | S | 8/1998 | Cardenas | |
| 5,810,213 | A | 9/1998 | Flores et al. | |
| 5,865,409 | A | 2/1999 | Nimer | |
| 5,957,352 | A | 9/1999 | Gares | |
| 5,967,426 | A | 10/1999 | McLeod | |
| 6,000,497 | A | 12/1999 | Kain et al. | |
| 6,070,808 | A | 6/2000 | Kildow | |
| 6,089,351 | A | 7/2000 | Ahl et al. | |
| 6,279,838 | B1 | 8/2001 | Sivells et al. | |
| D463,888 | S | 10/2002 | Rehkugler et al. | |
| 6,497,423 | B1 | 12/2002 | Perelli et al. | |
| D468,591 | S | 1/2003 | Lillelund et al. | |
| 6,536,557 | B2 | 3/2003 | Gibson et al. | |
| 6,695,235 | B2 | 2/2004 | Faller et al. | |
| 6,755,478 | B2 | 6/2004 | Messinger-Rapport | |
| 6,758,482 | B2 | 7/2004 | Stallbaumer | |
| 6,827,357 | B2 | 12/2004 | Calmeise et al. | |
| 6,837,383 | B1 | 1/2005 | McElhaney, Jr. | |
| 7,077,238 | B2 | 7/2006 | Butler et al. | |
| 7,175,031 | B2 | 2/2007 | Matthews | |
| 7,182,176 | B2 | 2/2007 | Gibson et al. | |
| D546,509 | S | 7/2007 | Gilpatrick | |
| 7,240,910 | B2 | 7/2007 | Stuemke | |
| 7,562,780 | B2 * | 7/2009 | Gilpatrick et al. | 211/70.6 |
| 2002/0017430 | A1 | 2/2002 | Rosko | |
| 2002/0109318 | A1 | 8/2002 | Calmeise et al. | |
| 2003/0122331 | A1 | 7/2003 | DiGiacomo et al. | |
| 2004/0046044 | A1 | 3/2004 | Bennett et al. | |
| 2004/0055979 | A1 | 3/2004 | Fabregas | |
| 2004/0217238 | A1 | 11/2004 | Chochinov et al. | |
| 2005/0056486 | A1 | 3/2005 | Butler et al. | |
| 2005/0252871 | A1 | 11/2005 | Le Roux | |

* cited by examiner

HOSE HOOK FOR A PRESSURE WASHER

This application is a continuation of co-pending U.S. patent application Ser. No. 11/003,156 filed on Dec. 3, 2004, the entire content of which is incorporated herein by reference.

BACKGROUND OF THE INVENTION

Accessory trays currently exist for holding pressure washer accessories.

SUMMARY OF THE INVENTION

According to the present invention, a pressure washer is provided having an accessory tray hose hook that can be used on most pressure washers regardless of the tray's angle of inclination. The pressure washer includes a frame having two frame members configured to be supported on a support surface, a prime mover coupled to the frame, an accessory tray coupled to the frame and including a main body portion extending between the two frame members, and a hose hook portion extending from the main body. The hose hook portion has a hose hook surface that is concave about a first axis and convex about a second axis that is substantially normal to the first axis, the hose hook surface configured to support a hose in a suspended position above the support surface.

Further aspects of the present invention, together with the organization and operation thereof, will become apparent from the following detailed description of the invention when taken in conjunction with the accompanying drawings.

DETAILED DESCRIPTION

Figure 1:
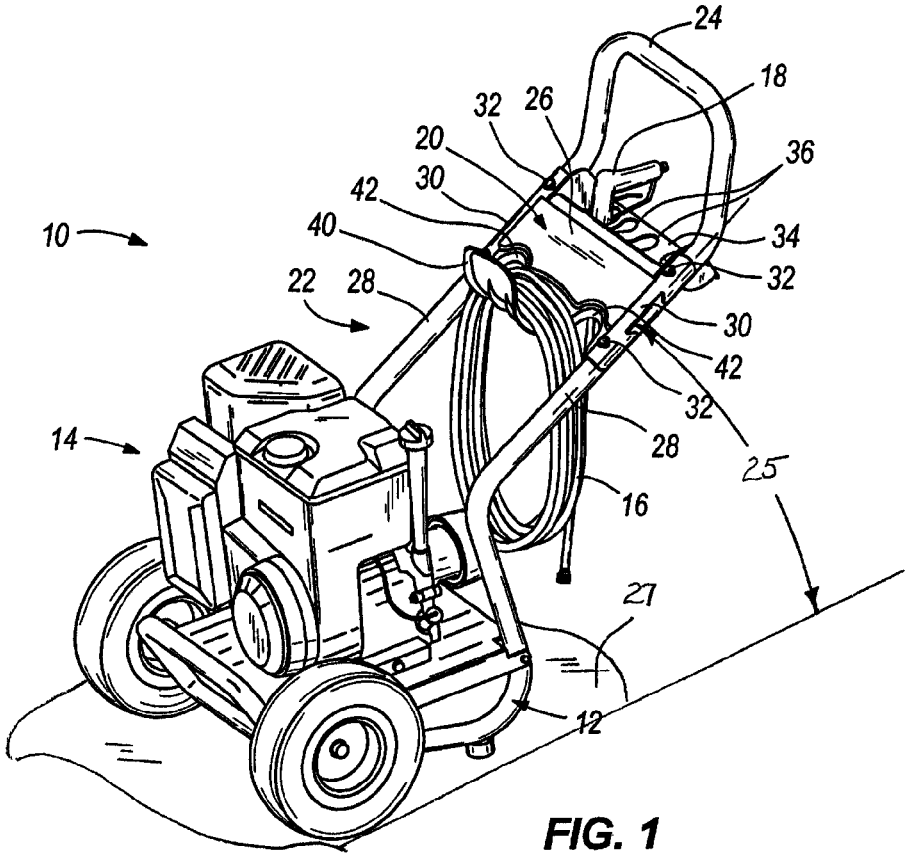
FIG. 1 is a perspective view of a pressure washer having one embodiment of an accessory tray embodying aspects of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Finally, as described in subsequent paragraphs, the specific mechanical configurations illustrated in the drawings are intended to exemplify embodiments of the invention. Accordingly, other alternative mechanical configurations are possible.

The pressure washer 10 shown in FIG. 1 includes a frame 12 and a prime mover 14 supported by the frame 12. The prime mover 14 can be an engine, electric motor, or fuel cell. The prime mover 14 generates a pressurized stream of fluid that is discharged via an accessory fluid line 16 coupled to the prime mover 14. One or more discharge control accessories 18, such as wands, spray guns, nozzles, and the like can be coupled to the fluid line 16 to control the discharge of pressurized fluid. An accessory tray 20 is coupled to the frame 12 of the pressure washer 10 to support one or more of the accessories 18 when not in use. As shown in FIG. 1, the discharge control accessories 18 and the fluid line 16 can be supported and stored on the accessory tray 20.

As previously mentioned, the accessory tray 20 is supported on the frame 12 of the pressure washer 10. As shown in FIG. 1, the accessory tray 20 is positioned on an inclined portion 22 of the frame 12. In some embodiments, this inclined portion 22 is an extension of the pressure washer frame 12 that extends toward a convenient position to be used as a handle 24 for moving the pressure washer 10. The frame 12 and/or the accessory portion defines an angle of inclination 25 relative to the ground or support surface 27. Generally, the angle of inclination of this inclined portion 22 of the frame 12 is not standardized between different models or between different manufacturers of pressure washers 10. Conventionally, this required a different accessory tray to be designed for each different angle of inclination to properly support the accessories 16, 18. However, the accessory tray 20 of the present invention is designed to be utilized on multiple different frames 12 that can have a wide variety of angles of inclination.

The accessory tray 20 has a main body portion 26 that generally extends between two inclined frame members 28 of the pressure washer frame 12. The ends 30 of the main body portion 26 are adapted to engage the frame members 28 and secure the accessory tray 20 to the pressure washer frame 12. In the illustrated embodiment, the ends 30 of the main body portion 26 have a curved configuration to match the curved configuration of the pressure washer frame 20. However, the ends 30 can be configured differently in other embodiments to engage frame members 28 having other configurations.

The ends 30 of the accessory tray 20 can be secured to the frame 12 in many different ways. For example, they can be adhesively or cohesively bonded, welded, snap fit, and the like. In the illustrated embodiment, fasteners 32 extend through apertures in the accessory tray to secure the accessory tray 20 to the frame 12.

Figure 6:
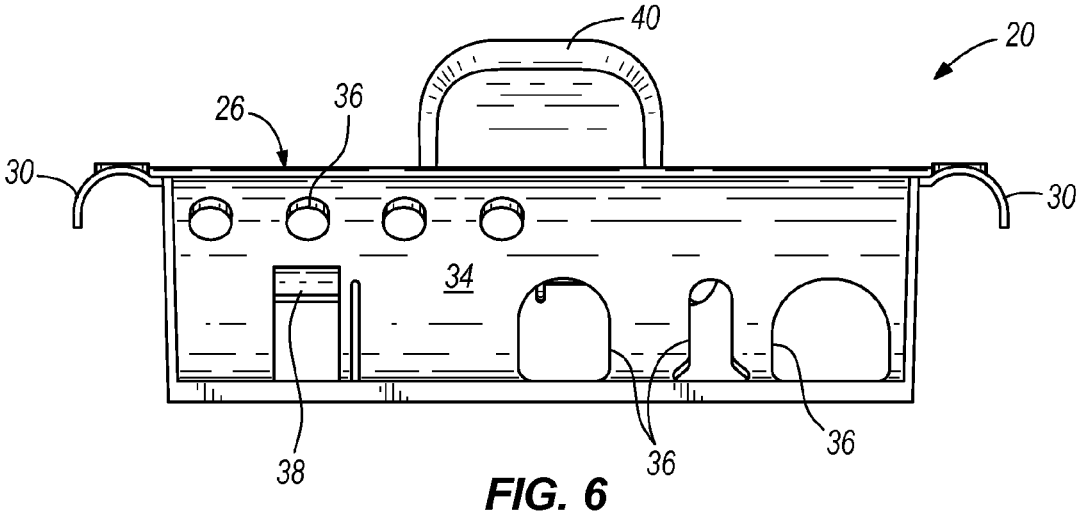
FIG. 6 is a rear view of the accessory tray shown in FIG. 1.
Figure 7:
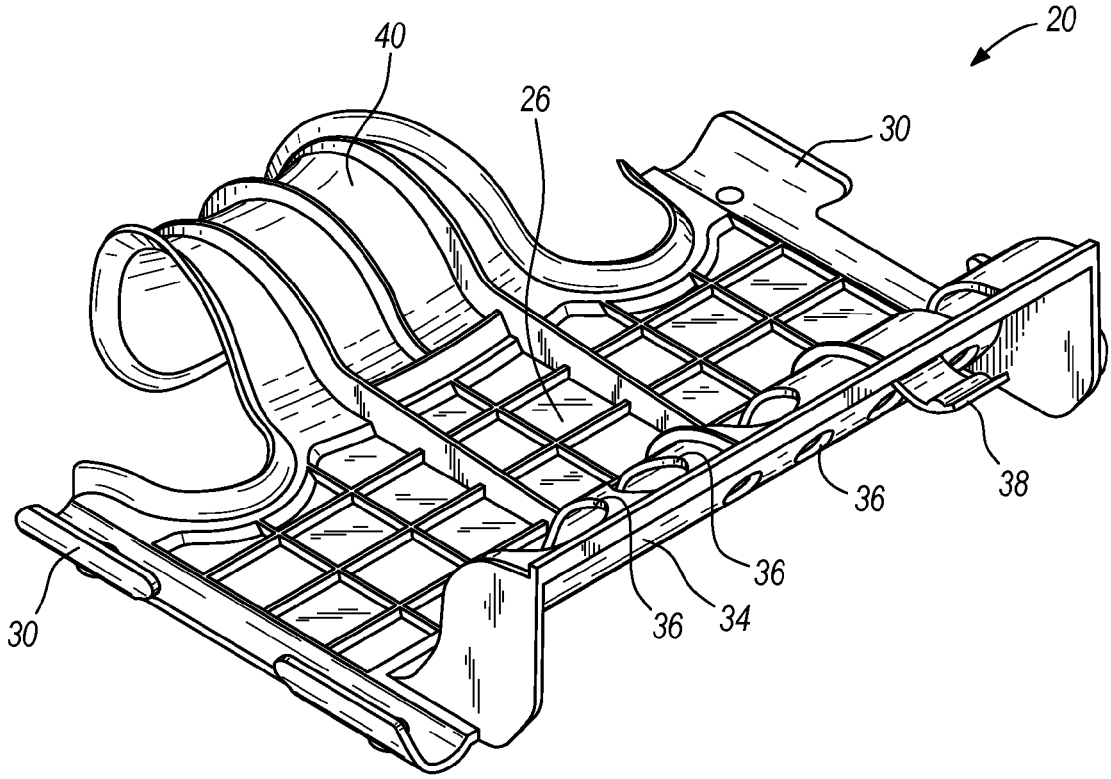
FIG. 7 is an additional perspective view of the accessory tray shown in FIG. 1.
Figure 8:
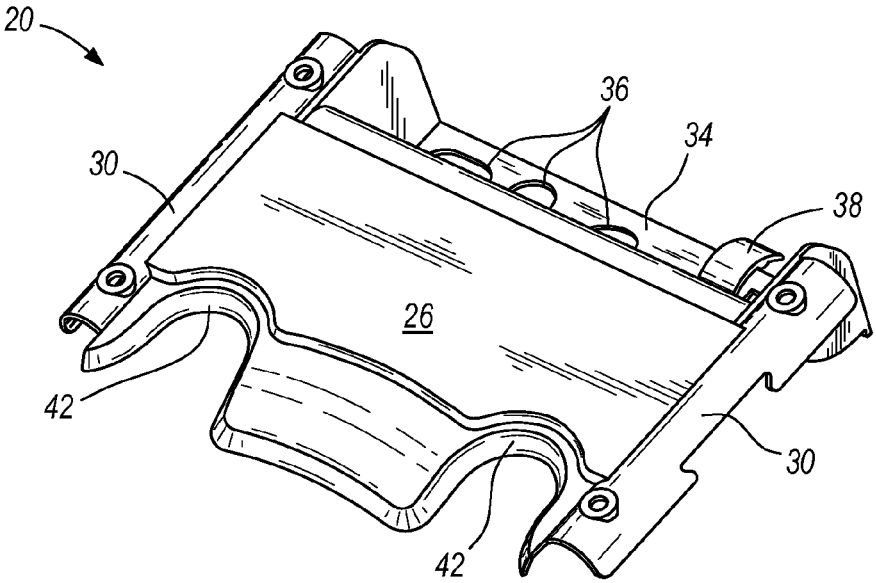
FIG. 8 is a perspective view of a second embodiment of an accessory tray embodying aspects of the invention.
Figure 9:
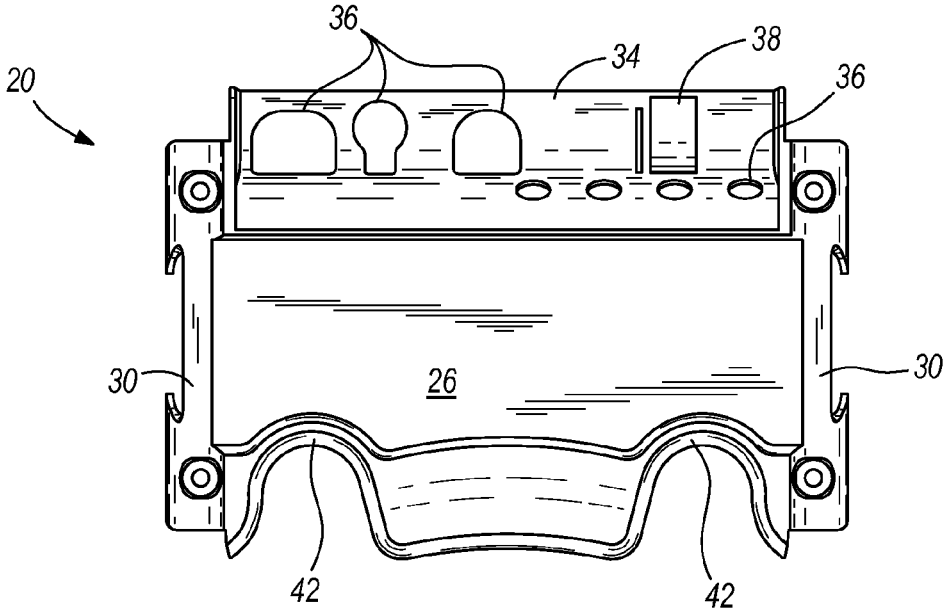
FIG. 9 is a top view of the accessory tray shown in FIG. 8.
Figure 10:
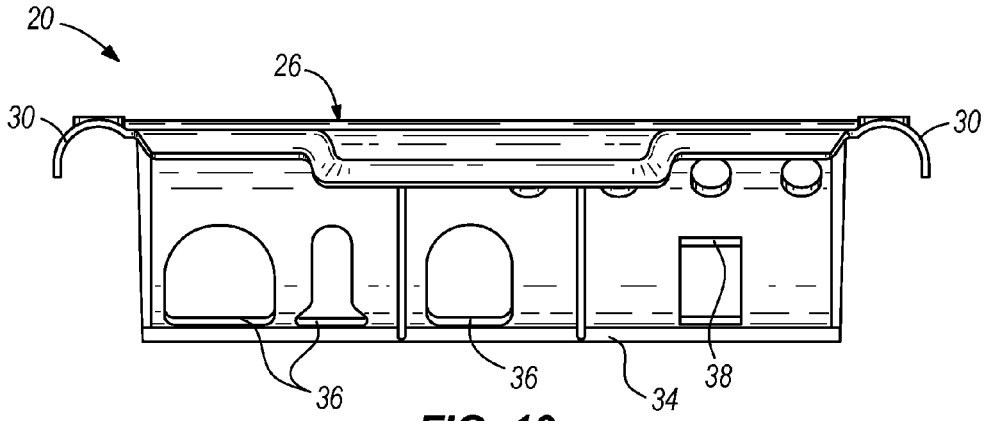
FIG. 10 is a front view of the accessory tray shown in FIG. 8.
Figure 11:
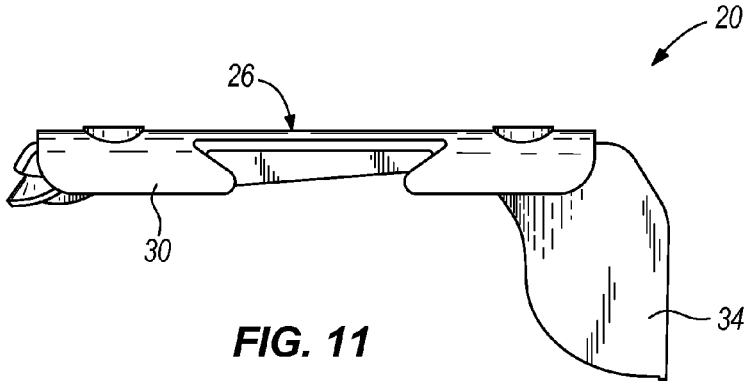
FIG. 11 is a right side view of the accessory tray shown in FIG. 8.
Figure 12:
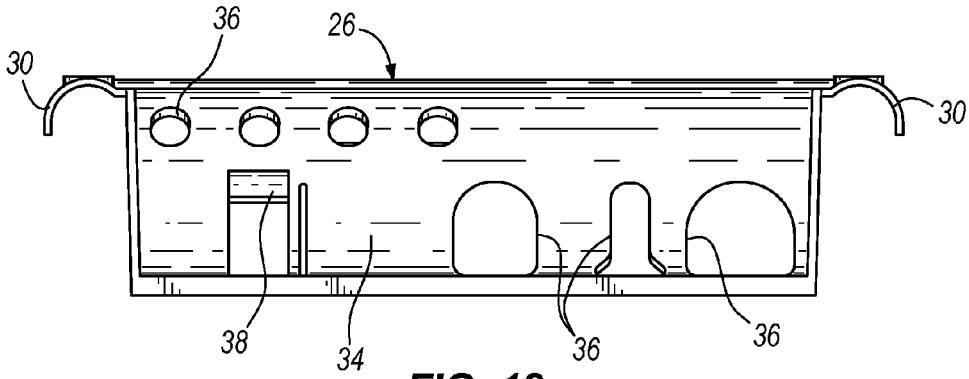
FIG. 12 is a rear view of the accessory tray shown in FIG. 8.
Figure 13:
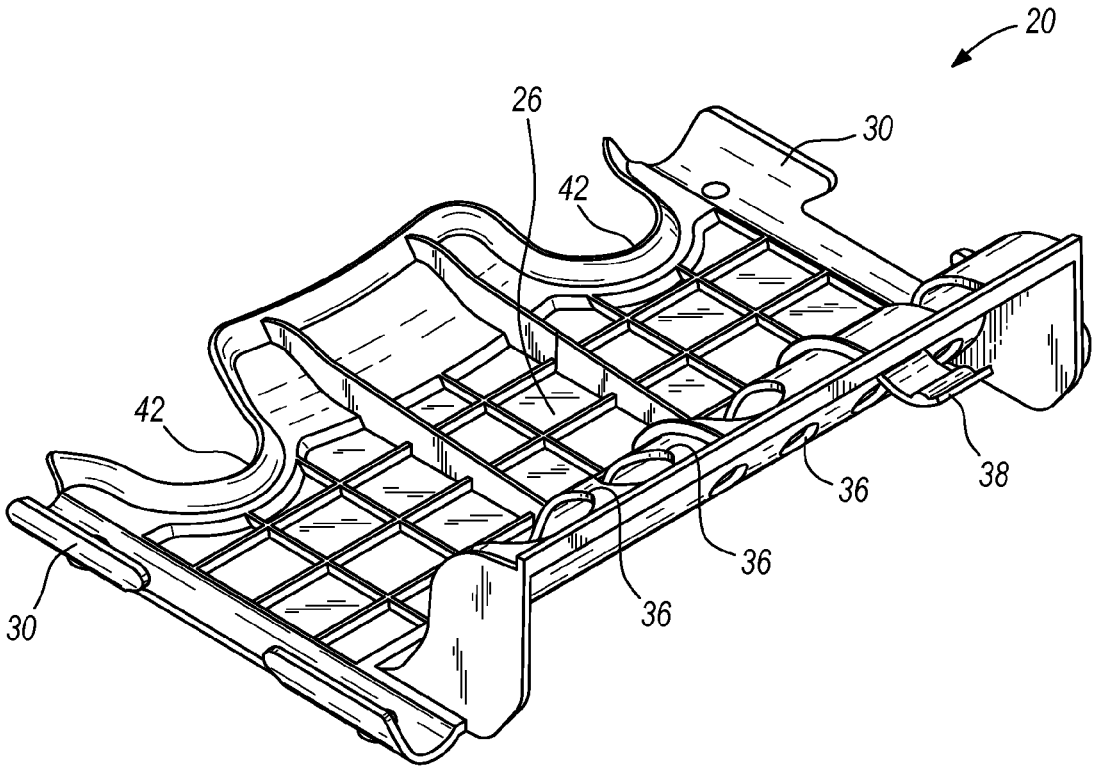
FIG. 13 is an additional perspective view of the accessory tray shown in FIG. 8.

An accessory supporting portion 34 of the accessory tray 20 is coupled to the main body portion 26. The accessory supporting portion 34 of the accessory tray 20 extends generally between the frame members 28. The accessory supporting portion 34 has a variety of accessory engaging mechanisms that can support one or more accessories. For example, as best shown in FIGS. 3, 6, and 7, several apertures 36 can extend through the accessory supporting portion 34 of the accessory tray 20 to receive and support accessories 18 in a suspended position above the ground. As illustrated, the apertures 36 can have a variety of different shapes to receive a variety of differently configured accessories 18. Furthermore, as shown in FIGS. 2 and 7, a clip or semi-flexible projection 38 can be positioned above the accessory supporting portion 34 of the accessory tray 20 to retain or trap accessories 18, such as nozzles, against the accessory supporting portion 34 of the accessory tray 20.

Figure 2:
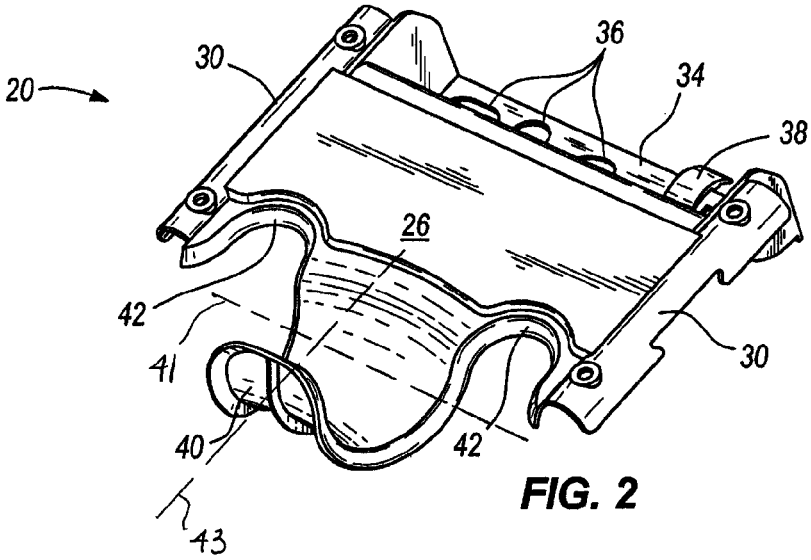
FIG. 2 is a perspective view of the accessory tray shown in FIG. 1.
Figure 3:
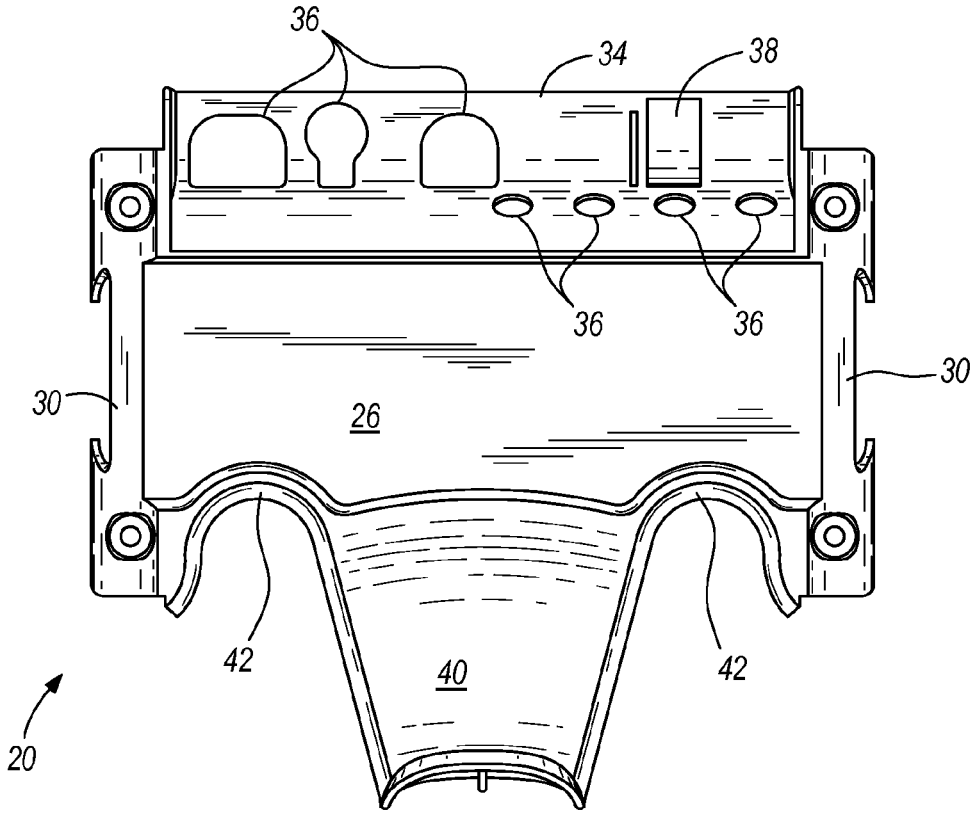
FIG. 3 is a top view of the accessory tray shown in FIG. 1.
Figure 5:
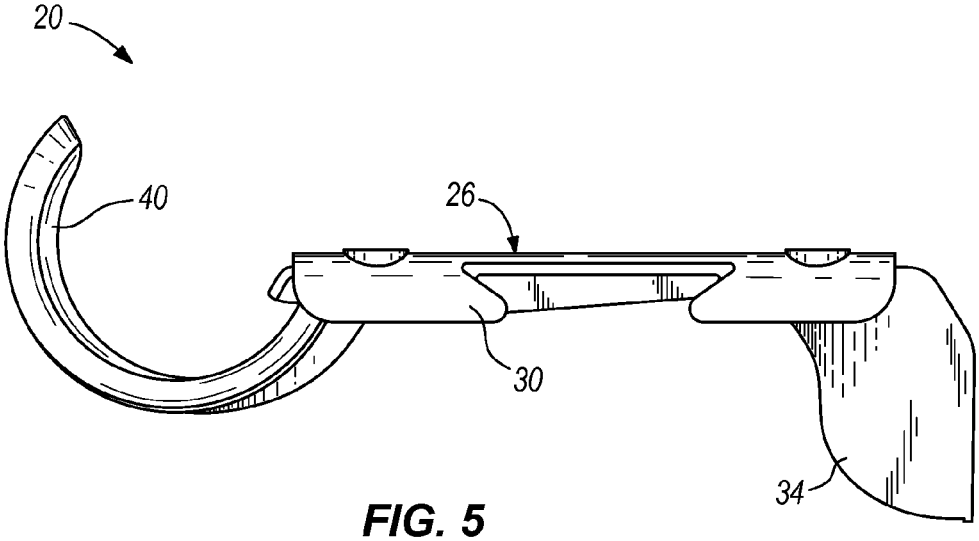
FIG. 5 is a right side view of the accessory tray shown in FIG. 1.

As best illustrated in FIGS. 2, 5, and 7, the accessory supporting portion 34 of the accessory tray 20 has a generally concave shape. The concave curved shape of the accessory supporting portion 34 of the accessory tray 20 allows the accessories 18 to engage the accessory tray 20 securely and rest substantially normal to the ground. For example, as shown in FIG. 1, a spray wand 18 is supported within the aperture 36 of the accessory tray 20 such that the wand 18 is oriented substantially normal to the ground or other support surface 27 of the pressure washer 10. Since the accessory supporting apertures 36 extend along a relatively large sector of the concave surface, accessories 18 can securely rest within the apertures 36 at an angle that is substantially normal to the ground 27 over a wide variety of angles of the accessory tray 20. Specifically, the concave shape allows the accessories 18 to rest against the accessory tray 20 at a location that has a tangent which is substantially normal to the accessory 18 as it extends through the aperture 36. Accordingly, this engagement allows the accessory 18 to be securely supported normal to the ground 27 over a wide variety of frame inclination angles. In some embodiments, accessories 18 can be supported substantially normal to the ground 27 by the concave surface over a range of inclination angles from about zero degrees to about ninety degrees (assuming the aperture extends along a large enough sector of the concave surface). This feature is advantageous because it allows a single universal accessory tray design for multiple pressure washer frame configurations.

A projection 40 also extends from the main body portion 26 of the accessory tray 20 to provide a hose hook. The hose hook 40 is positioned opposite the accessory supporting portion 34 of the accessory tray 20. The hose hook 40 allows the accessory fluid line or hose 16 to be supported and stored on the accessory tray 20. The hose hook 40 also has a concave shape to allow the fluid line 16 to be supported substantially normal to the ground 27 regardless of the frame's 12 angle of inclination. The fluid line 16 can be supported by the concave surface in a substantially normal orientation relative to the ground 27 when the frame's angle of inclination relative to the ground 27 ranges from about zero degrees to about ninety degrees.

Figure 4:
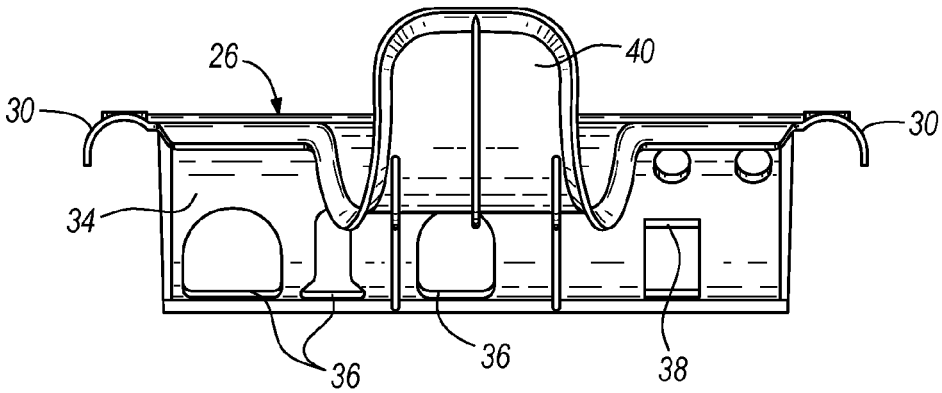
FIG. 4 is a front view of the accessory tray shown in FIG. 1.

As illustrated in FIGS. 2-5, the hose hook 40 has a saddle-like shape. In other words, the hose hook 40 has a concave shape about a first axis 41 and a convex shape about an additional axis 43 that is normal to and non-intersecting with the first axis 41 (FIG. 2). As shown in FIG. 1, the first axis 41 would extend in a direction that is generally normal to the frame member 28 of the pressure washer frame 12, while the additional axis 43 would generally extend in a direction that does not intersect the frame members 28. The hose hook 40 also tapers as it extends away from the main body portion 26. For example, as shown in FIGS. 3 and 4, the hook 40 has a first width at the main body portion 26 and a second width at the distal end of the hook 40. The first width of the hook is greater than the second width.

Recesses 42 are positioned on either side of the hose hook 40 and extend into the main body portion 26 of the accessory tray 20. These recesses 42 prevent the main body portion 26 from interfering with the orientation of the fluid line 16 when a large quantity of fluid line 16 is supported by the hook 40 and/or when the accessory tray 20 is positioned at a relatively low angle of inclination relative to the ground 27.

A second embodiment of the accessory tray 20 is illustrated in FIGS. 8-13. As illustrated in these figures, this embodiment is constructed substantially similarly to the embodiment shown in FIGS. 1-7. The major difference between the two embodiments is that the hose hook 40 is eliminated in the second embodiment.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

What is claimed is:

1. A pressure washer comprising:

a frame configured to be supported on a support surface, the frame having two frame members;

a prime mover coupled to the frame;

an accessory tray coupled to the frame, the accessory tray including a main body portion extending between the two frame members;

a hose hook portion extending from the main body portion, the hose hook portion having a hose hook surface configured to support a hose from a receiving side of the hose hook surface in a suspended position above the support surface;

wherein at least a portion of the hose hook surface is entirely concave with respect to a first axis positioned on the receiving side of the hose hook surface, and wherein the at least a portion of the hose hook surface that is entirely concave with respect to the first axis is also entirely convex with respect to a second axis positioned on the receiving side of the hose hook surface.

2. The pressure washer of claim 1, wherein the hose hook surface has a width that extends in a direction from one of the two frame members toward another of the two frame members, wherein the width decreases as the hose hook surface extends away from the main body portion.

3. The pressure washer of claim 1, wherein the accessory tray includes a pair of recesses extending into the main body portion, and wherein one recess of the pair of recesses is positioned on each side of the hose hook portion.

4. The pressure washer of claim 1, wherein the first axis extends substantially normal to the frame members.

5. The pressure washer of claim 4, wherein the second axis is substantially oriented to be non-intersecting with the frame members.

6. The pressure washer of claim 1, wherein the accessory tray includes a first end configured to be coupled to one of the two frame members and a second end configured to be coupled to the other of the two frame members.

7. The pressure washer of claim 1, wherein the accessory tray also includes an accessory supporting portion, and wherein the hose hook portion is positioned opposite the accessory supporting portion.

8. The pressure washer of claim 1, wherein the hose hook portion is configured to support the hose in a substantially normal orientation relative to the support surface for a first angle of inclination of the frame relative to the support surface and for a second angle of inclination of the frame relative to the support surface, wherein the second angle of inclination is different than the first angle of inclination, and wherein the first and second angles of inclination are between zero degrees and ninety degrees.

9. The pressure washer of claim 1, wherein the accessory tray further includes an accessory supporting portion having at least one aperture for receiving an accessory of the pressure washer, and wherein the accessory tray further includes a flexible cantilevered member configured to retain a second accessory against the accessory supporting portion of the accessory tray.

10. The pressure washer of claim 1, wherein the accessory tray further includes an accessory supporting portion including a concave surface having at least one aperture for receiving an accessory of the pressure washer, the concave surface supporting the accessory substantially normal to the support surface for a first angle of inclination of the accessory tray relative to the support surface and for a second angle of inclination of the accessory tray relative to the support surface, wherein the second angle is different than the first angle.

11. The pressure washer of claim 10, wherein a difference between the first and second angles is greater than ten degrees.

12. The pressure washer of claim 10, wherein a difference between the first and second angles is less than ninety degrees.

13. The pressure washer of claim 10, wherein the concave surface of the accessory supporting portion has first and second tangents, wherein the first tangent is non-parallel to the second tangent, and wherein the least one aperture is configured such that the first tangent is parallel to the support surface for the first angle of inclination of the accessory tray relative to the support surface, and the second tangent is parallel to the support surface for the second angle of inclination of the accessory tray relative to the support surface, such that the accessory of the pressure washer received by the at least one aperture is received normally to the support surface for the first and second angles of inclination of the accessory tray relative to the support surface.

14. The pressure washer of claim 1, wherein the accessory tray includes an accessory supporting portion having at least one aperture for receiving at least one of a pressure washer spray gun and a nozzle for the spray gun.

15. The pressure washer of claim 1, wherein the accessory tray includes an accessory supporting portion having a concave surface with respect to an axis that is both parallel to the accessory supporting portion and that is located on a side of the accessory supporting portion from which an accessory of the pressure washer is received.

16. The pressure washer of claim 15, wherein the concave surface has first and second tangents, wherein the concave surface includes the at least one aperture, and wherein the at least one aperture is configured such that one of the first tangent is parallel to the support surface for a first angle of inclination of the accessory tray relative to the support surface and the second tangent is parallel to the support surface for a second angle of inclination of the accessory tray relative to the support surface, wherein the second angle is different than the first angle, such that the accessory of the pressure washer received by the at least one aperture is received normal to the support surface for the first and second angles of inclination of the accessory tray relative to the support surface.

17. The pressure washer of claim 16, wherein the at least one aperture is configured to receive at least one of a pressure washer spray gun and a nozzle for the spray gun.

18. The pressure washer of claim 1, wherein the first axis is substantially normal to the second axis.

* * * * *